US005934752A

United States Patent [19]

Klingler

[11] Patent Number: 5,934,752

[45] Date of Patent: Aug. 10, 1999

[54] RESILIENT CURVE ELEMENT OF PLASTICS MATERIAL WITH LONGITUDINAL AND TRANSVERSE STRUTS FOR A LORDOSIS SUPPORT WITH ADJUSTABLE CURVATURE

[75] Inventor: Knud Klingler, Nürnberg, Germany

[73] Assignee: Ameu Management Corp., Panama, Panama

[21] Appl. No.: 08/860,743

[22] PCT Filed: Dec. 14, 1995

[86] PCT No.: PCT/EP95/04947

§ 371 Date: Nov. 17, 1997

§ 102(e) Date: Nov. 17, 1997

[87] PCT Pub. No.: WO96/18326

PCT Pub. Date: Jun. 20, 1996

[30] Foreign Application Priority Data

Dec. 15, 1995 [DE] Germany ..... 44 44 803

[51] Int. Cl.[6] ..... A47C 3/025; A47C 7/46

[52] U.S. Cl. ..... 297/284.4; 297/284.1; 297/284.9; 297/284.7

[58] Field of Search ..... 297/284.4, 284.1, 297/284.3, 284.7, 284.9

[56] References Cited

U.S. PATENT DOCUMENTS

| | | | |
|---|---|---|---|
| 4,316,631 | 2/1982 | Lenz et al. | 297/284.4 |
| 5,217,278 | 6/1993 | Harrison et al. | 297/284.7 |
| 5,299,851 | 4/1994 | Kuen-Yuan Lin | 297/284.4 X |
| 5,397,164 | 3/1995 | Schuster et al. | 297/284.4 X |
| 5,449,219 | 9/1995 | Hay et al. | 297/287.4 |
| 5,518,294 | 5/1996 | Ligon, Sr. et al. | 297/284.4 |
| 5,567,010 | 10/1996 | Sparks | 297/284.4 |
| 5,588,703 | 12/1996 | Itou | 297/284.4 |
| 5,609,394 | 3/1997 | Ligon, Sr. et al. | 297/284.4 |
| 5,651,583 | 7/1997 | Klingler et al. | 297/284.4 |
| 5,651,584 | 7/1997 | Chenot et al. | 297/284.4 |
| 5,704,687 | 1/1998 | Klingler | 297/284.4 |
| 5,762,397 | 6/1998 | Venuto et al. | 297/284.4 |
| 5,816,653 | 10/1998 | Benson | 297/284.1 X |

FOREIGN PATENT DOCUMENTS

| | | | |
|---|---|---|---|
| 0 0322 535 | 7/1989 | European Pat. Off. . | |
| 0 698 360 A1 | 8/1995 | European Pat. Off. . | |
| 2935352 | 3/1980 | Germany | 297/284.4 |
| 2 947 472 | 10/1980 | Germany . | |
| 4 320 105 | 10/1994 | Germany . | |
| 2149654 | 6/1985 | United Kingdom | 297/284.4 |
| 94/07393 | 4/1994 | WIPO | 297/284.4 |
| WO 95/00053 | 1/1995 | WIPO . | |

*Primary Examiner*—Peter M. Cuomo
*Assistant Examiner*—Rodney B. White
*Attorney, Agent, or Firm*—Howard & Howard

[57] ABSTRACT

An elastic contouring assembly for a lumbar support system includes an adjustable contouring element having a central longitudinal strut and an integral shoulder for attachent of an adjustment device. A tensioning cable having one end attached to the contouring element and an opposite end attached to the adjustment adjusts the curvature of the contouring element. Guide elements extend from the central longitudinal strut and include aperatures to receive the tensioning cable. Each of the apertures define an individual clearance height from the central longitudinal strut, and as the clearence heights differ, the radius of the contouring element can be adjusted by extending or retracting the tensioning cable.

15 Claims, 2 Drawing Sheets

RESILIENT CURVE ELEMENT OF PLASTICS MATERIAL WITH LONGITUDINAL AND TRANSVERSE STRUTS FOR A LORDOSIS SUPPORT WITH ADJUSTABLE CURVATURE

The invention concerns an elastic contouring element made of plastic with longitudinal and transverse struts for a lumbar support system having an adjustable curvature including a tensioning device, one end of which is connected to a contouring element by means of a fastening element and the other end of which is connected to a cam device for adjusting the curvature of the contouring element.

Such a contouring element is known from the DE-C1-43 20 105. The contouring element known from it requires additional parts with regard to its connection to the adjustment device and a considerable amount of assembly time.

It is the object of the invention to improve a contouring element for lumbar support in such a manner that it can be simply manufactured in a cost-effective way and that it can be assembled at low cost. It is a further object of the invention to attach a contouring element simply and quickly to a frame or a part of a frame of a back-rest without tools.

The first-mentioned object is achieved by a contouring element with the characteristics of claim 1. Advantageous embodiments of the invention can be seen in the subordinate claims.

Figure 1:
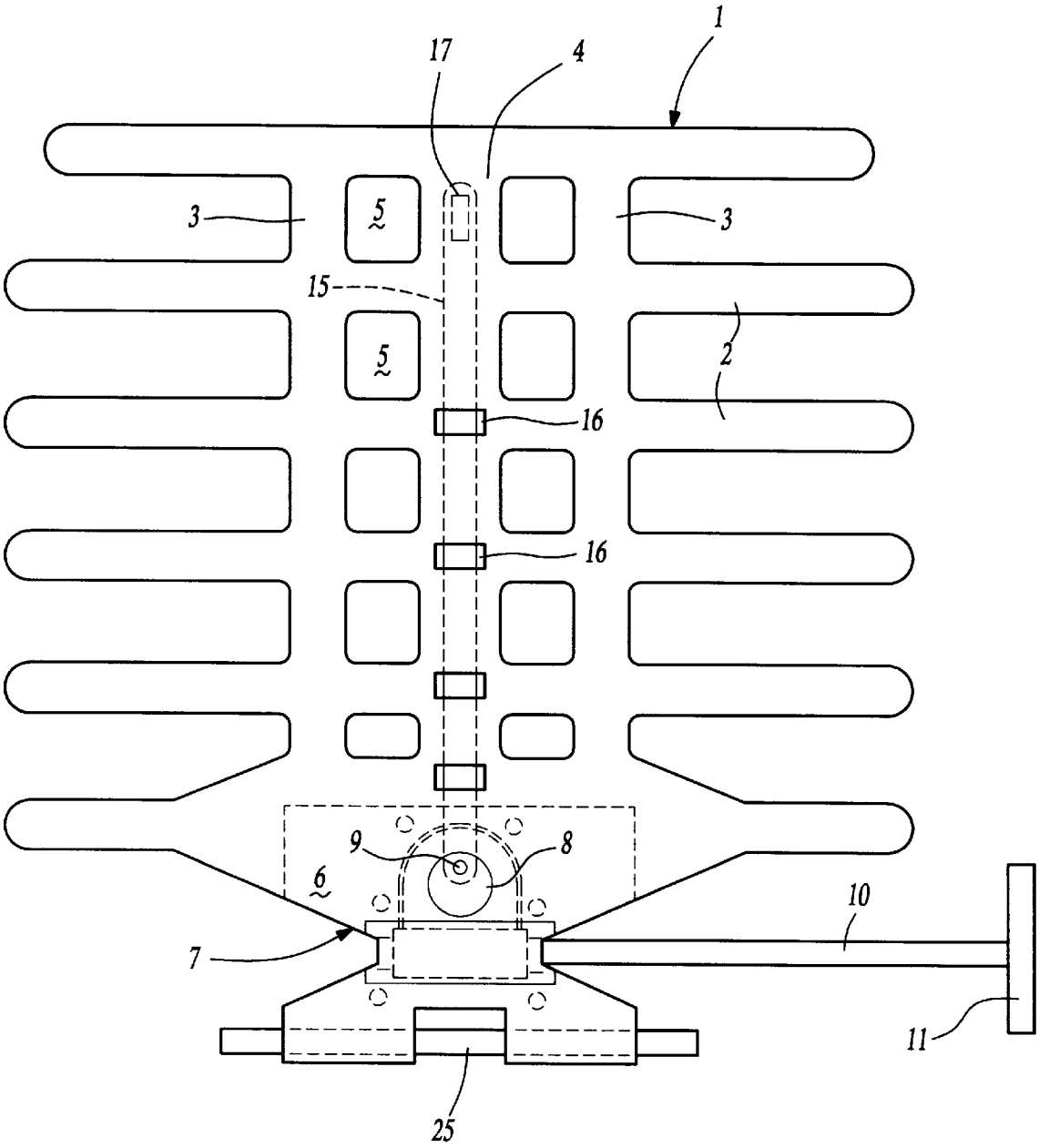
Figure 2:
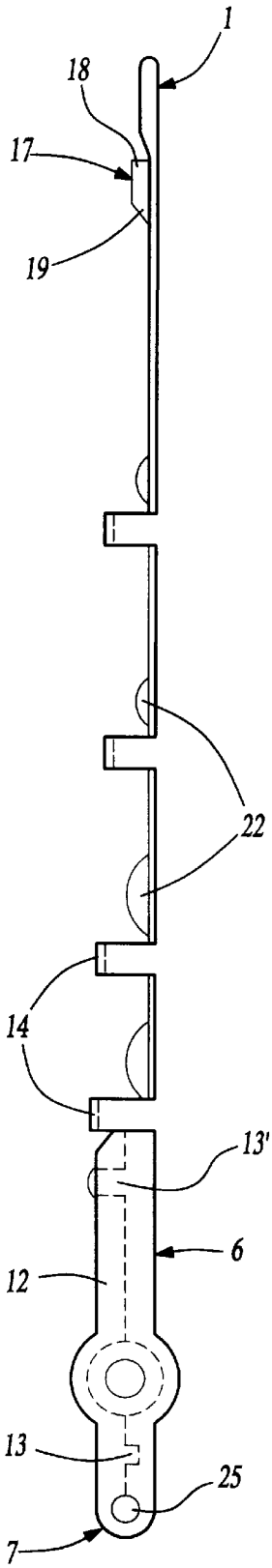
Figure 3:
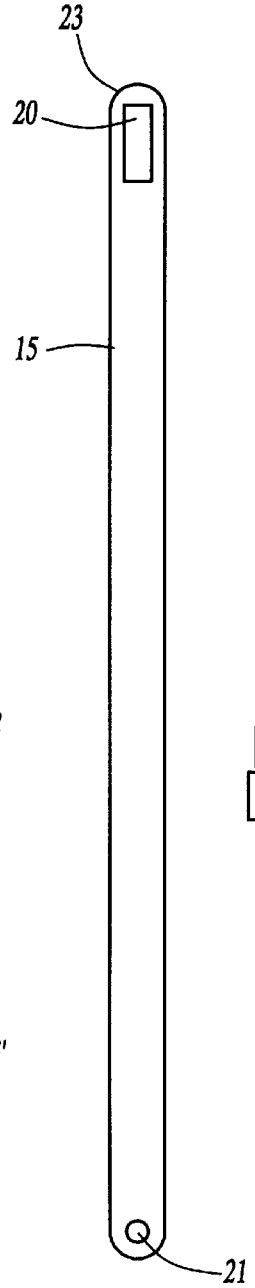
Figure 4:
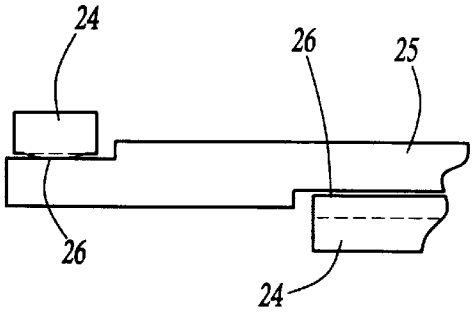

Below, the invention is described in more detail on the basis of the example of an embodiment with reference to drawings. The following is shown:

FIG. 1A top view of a contouring element according to the invention,

FIG. 2 a cross-section through a contouring element according to FIG. 1, FIG. 3 a tensioning device, FIG. 4 a sectional view of a round peg with flat portions located opposite each other at the center portion and at the exposed ends.

The contouring element 1 consists of a truss-like structure with transverse struts 2 and longitudinal struts 3. In the example of the embodiment, in addition to a central strut 4 two further longitudinal struts 3 are arranged on either side of it and parallel to it, which form a central truss-like structure with the transverse struts 2, which connect them to each other, and where the entire structure can be curved around a horizontal axis by means of the longitudinal struts 3, 4. The transverse struts 2 protrude beyond this central truss-like structure on both sides and can be arranged at an angle to it in order to assure a lateral support. The contouring element 1 consists preferably entirely of plastic, while, however, support inserts made of any material desired, e.g. metal, and/or reinforcing ribs can be used. In order to save weight and/or to affect the bending properties and the stability and stiffness, recesses 5 can be provided. At the lower end of the contouring element 1 a shoulder 6 has been provided, which has been made an integral part of the contouring element 1.

In the example of the embodiment, the shoulder 6 is a part of a housing 7 for receiving and supporting an adjustment device. The adjustment device contains a rotatable disk 8, which can be supported in the housing 7, and which contains a cam 9, and where the disk 8 is firmly connected to or is an integral part of a gear with helical teeth, which is not shown, which meshes with a worm gear (not shown), which is supported in the housing 7, and where the worm gear is connected non-rotatably to a hand wheel 11 by way of an extension 10. The worm gear is turned by means of the hand wheel 11, which causes the gear and thus also the disk 8 along with the cam 9 to be rotated.

In the example of an embodiment the housing 7 consists of the shoulder 6 and a corresponding locking part 12, whose contour is shown in FIG. 1, partly as a dotted line. The shoulder 6 and the locking part 12 contain protrusions or recesses 13, 13', which are indicated, for example, in FIG. 2, and which function as guide means and/or snap connections for joining and holding together the shoulder 6 and the locking part 12 to form the closed housing 7, as soon as the disk 8, with the cam 9 and the helical gear as well as the worm gear with the extension 10 and the hand wheel 11 are inserted into the corresponding indentations or recesses in the shoulder 6 and in the locking part 12. The protrusions and indentations 13' can all be shaped in such a manner that they correspond to the thickness of the shoulder 6 or the locking part 12, so that the free end of the protrusion can be welded in place, for example by ultrasound, at the exit point of the open indentation extended through it. Shoulder 6 and locking part 12 may also merely contain aligned bores (not shown), which can be firmly joined to each other by means of suitable rivet or screw connections.

The locking part 12 can also be made as an integral part of the shoulder 6 of the contouring element 1 by way of a thin portion of the material, which will function as a joint. In order to close the housing 7 it will now merely be necessary to rotate the locking part 12 by 180° and to connect it firmly to the shoulder 6.

On the back side of the contouring element 1 on the central strut 4, preferably in the region of the transverse struts 2, bridge elements 14 have been placed, which have the function of receiving and guiding a tensioning device 15. Preferably, the tensioning device 15 is designed to be elastic in bending, similar to a leaf spring, and it can be made of a metal, but also of a plastic or other materials, which are elastic in bending. In order to be able to manufacture the bridge elements 14 as an integral part of the contouring element 1 by means of a casting or a molding process, the central strut 4 contains apertures 16 in the region where the bridge elements 14 are located.

At the upper end of the contouring element 1 a fastening element 17 for the tensioning device 15 is placed, which is located on the central strut 4 at the extension of the central axis of the bridge elements 14. In the example of the embodiment shown, the fastening element 17 consists of a locking protrusion 18 with a glide ramp 19, which is directed toward the shoulder 6. The tensioning device 15 contains a locking recess 20, the size of which is such that the locking protrusion 18 and the glide ramp 19 can be enclosed by it. The tensioning device 15 contains at the end, which is located opposite the locking recess 20, a locking bore 21, the diameter of which has been selected in such a way that it can receive, free from backlash or with little backlash, the cam 8 in a manner that allows it to rotate.

Starting at the shoulder 6, the bridge elements 14 have a reduced clearance height in the direction toward the fastening element 17. On the central strut 4, adjacent to the bridge elements 14—preferably to all—elevated portions 22 may be provided, which preferably limit the clearance height to the thickness of the tensioning device 15. By the selection of the clearance height and/or the number and the height of the elevated portions, the contouring characteristics can be adjusted; for example, a radius of curvature can be chosen, which differs as a function of height. The radius of curvature can also be varied on the basis of the distance of the bridging members 14 from each other. By varying the distance between the locking opening 20 and the locking bore 21 in the tensioning device 15, the pre-tensioning of the contouring element 1 can be predetermined.

A variant for fastening the tensioning device 15 at the upper end of the contouring element 1, which is not shown, may look as follows. In this variant, the fastening element 17 consists of a transverse slot in the central strut 4 and the tensioning cable 15 contains a hook-shaped bent portion at its upper end 23, which is capable of being inserted into the transverse slot.

When the adjustment device has been placed inside the housing 7 and the housing is closed, the tensioning device 15 with the locking opening 20 is pushed forwardly from the shoulder 6 under the bridge elements 14 and, if required, across the raised portion 22. In this process the front end 23 of the tensioning device 15 gets to the glide ramp 19, and its locking opening 20 is locked in place behind the locking protrusion 18, because the end of the tensioning cable 23 is pre-tensioned by the ascending slope of the ramp when the locking opening 20 slides across the free end of the locking protrusion 18. Under certain circumstances, while the contouring element 1 experiences a small degree of manual curvilinear deflection, the locking bore 21 is now positioned above the cam 9. By means of the pre-tensioning of the end of the tensioning device 15 with respect to the locking opening 20, which is brought about by the clearance height of the adjacent pair of bridging strut 14 and elevated portion 22, it (the locking opening) slides on the cam 9 until it—allowing a relative rotation between the cam 9 and the tensioning cable 15—is positioned at the bottom of the cam in contact with the disk 8. Thus, a firm connection between the tensioning device 15 and the cam device has been made without a tool having been required. The attachment can, however, also be made, for example, by means of a rivet joint or a snap ring.

In the example of the embodiment a fastening element is provided at the lower end of the housing 7 for positioning the contouring element 1 within the support parts 24 (see FIG. 4), which are directly attached to the frame or indirectly fastened to an additional frame portion of a back-rest. The fastening element is preferably constructed as a round peg 25, whose central portion is exposed in the housing 7 and whose ends protrude from the housing 7 (see FIG. 1). In FIG. 4 a view of an example of an embodiment of a round peg 25 is shown in the plane of the view according to FIG. 1. From it one can see that the central portion and the exposed ends are provided with flat areas 26 in such a manner that the flat areas 26 are displaced from the central portion and that, at the ends, they are offset relative to each other by 180°. The support parts 24 are made more or less hook-shaped, and there is a clearance distance between the hook-shaped parts, when they are transported in a plane, which clearance corresponds exactly to the thickness of the round peg 25 minus the thickness of the flat areas 26 at one end and at the central portion. This clearance can, for example in the case of a round peg 25, which has a diameter of 5 mm and contains each of the flat areas, amount to from 1 to 3 mm. Below the hook-shaped parts the support parts are spaced at a distance from each other that is equal to or somewhat greater than the diameter of the round peg 25.

Thus, in the position shown in FIG. 4, the round peg 25 and thus the contouring element 1 can be inserted between the hook-shaped support parts 24, after which, subsequent to a slight rotation about the axis of the round peg 25—by only a few degrees—it can no longer be removed from the support due to the now effective diameter of 5 mm. In this manner an extremely quick and secure mounting of the contouring elements to the frame or frame part is made possible.

The round peg 25 may not contain any flat areas in other examples of embodiments, and it may be possible to insert it into appropriate support members, for example U-shaped support members with elastic legs or cap.-like holders, which can be elastically rotated for enclosing the ends of the round peg (all not shown). Further, the contouring element 1 may contain fastening and/or guide elements for attaching it to frame parts without the use of tools, for example, to round rods, and for example, in the form of clips.

I claim:

1. An elastic contouring element with longitudinal and transverse struts for a lumbar support system with an adjustable curvature and a tensioning device having a first end and an opposite second end said first end of which is connected to the contouring element by a fastening element and an opposite second end of which is connected to an adjustment device for adjusting the curvature of the contouring element, characterized in that the contouring element includes an integral shoulder, the shoulder being attached to a housing for receiving and supporting the adjustment device, and a plurality of bridge elements extending from a central longitudinal strut of the contouring element to guide the tensioning cable, each of the bridge elements defining a clearance height between the tensioning device and the central longitudinal strut.

2. Contouring element according to claim 1, characterized in that the clearance heights of the bridge elements decrease as the bridge elements approach the fastening element.

3. Contouring element according to claim 1, characterized in that at least one bridge element is equipped with an elevated portion on the central longitudinal strut, which limits the clearance height for the tensioning cable.

4. Contouring element according to claim 3, characterized in that the clearance height, which is limited by the bridge element and the elevated portion, corresponds to the thickness of the tensioning device.

5. Contouring element according to claim 1, characterized in that the fastening element consists of a locking protrusion and a corresponding locking opening at the contouring element or in the tensioning device.

6. Contouring element according to claim 5, characterized in that the locking protrusion is an integral part of the contouring element and contains a glide ramp facing the shoulder.

7. Contouring element according to claim 5, characterized in that the locking protrusion is a bent, hook-shaped part of the tensioning device, which can be inserted into a locking opening provided in the central strut.

8. Contouring element according to claim 1, characterized in that the tensioning device contains a locking bore for receiving the cam.

9. Contouring element according to claim 1, characterized in that the shoulder is additionally connected to the rotatable locking part of the housing by means of a thinner material section, which functions as a joint.

10. Contouring element according to claim 9, characterized in that the shoulder and the locking part of the housing contain mutual guiding means in the form of projections and recesses.

11. Contouring element according to claim 1, characterized in that the contouring element contains integral fastening elements for the attachment to frame parts of a seat.

12. Contouring element according to claim 11, characterized in that the fastening element consists of a round peg located in the housing such that a portion of the peg is exposed.

13. Contouring element according to claim 12, characterized in that the round peg is exposed at a central portion and at each end, the central portion having a flats area offset by 180° with respect to a flat area located at each exposed end.

14. An elastic contouring assembly for a lumbar support system, comprising:

a contouring element having a central portion including a longitudinally extending central strut;

an adjustment device;

a tensioning device having one end attached to said contouring element and an opposite end attached to said adjustment device to adjust the curvature of said contouring element; and, guide elements extending from spaced apart intermediate locations on said central strut of said contouring element, each of said guide elements having an aperture to receive said tensioning device.

15. The assembly of claim 14, wherein each of said apertures define an individual clearance height from said contouring elements, said clearance height differing for each of said guide elements.

* * * * *